US005844455A

United States Patent [19]

Song

[11] Patent Number: 5,844,455

[45] Date of Patent: Dec. 1, 1998

[54] CURRENT LIMITING APPARATUS FOR CIRCUIT BREAKER

[75] Inventor: Do Yong Song, Daejon, Rep. of Korea

[73] Assignee: LG Industrial Systems Co., Ltd., Seoul, Rep. of Korea

[21] Appl. No.: 864,107

[22] Filed: May 28, 1997

[30] Foreign Application Priority Data

May 28, 1996 [KR] Rep. of Korea ..... 18294/1996

[51] Int. Cl.[6] ..... H01H 75/00

[52] U.S. Cl. ..... 335/16; 218/22

[58] Field of Search ..... 335/23.5, 16, 147, 335/195; 218/22

[56] References Cited

U.S. PATENT DOCUMENTS 4,528,531 7/1985 Flick et al. ..... 335/23

4,855,549 8/1989 Toda et al. ..... 200/401

*Primary Examiner*—Lincoln Donovan

*Attorney, Agent, or Firm*—Birch, Stewart, Kolasch & Birch, LLP

[57] ABSTRACT

A current-limiting apparatus for a circuit breaker which makes it possible to effectively protect an electric load element by quickly blocking an electric flow path when an excessive current flows due to a ground, shortage, etc. at an electric flow path and preventing a re-formation of an electric flow path after the electric flow path is blocked. The apparatus includes a guide pin passing through the second pin hole and being extended from both side surfaces of the movable contact member, a holder, a portion of which support both ends of the movable contact member rotation center pin, for rotatably supporting the movable contact member, a current-limiting latch having a curved guide surface formed on one outer circumferential surface of the same on which the guide pin slidably moves, a support groove formed on another outer circumferential surface of the same, and a pin hole for supporting the holder, a rotation center pin inserted into the pin hole of the current-limiting latch, both ends of which rotation center pin are inserted into portions of the holder, and a contact spring, both ends of which are supported by the support groove of the current-limiting latch and the support surface of the holder, for generating a variable force which prevents the movable contact member from being rotated.

7 Claims, 5 Drawing Sheets

CURRENT LIMITING APPARATUS FOR CIRCUIT BREAKER

BACKGROUND OF THE INVENTION

1. Field of the Invention

The present invention relates to a current limiting apparatus for a circuit breaker, and in particular to an improved current limiting apparatus for a circuit breaker which is capable of effectively protecting an electric load element by quickly blocking an electric flow path when an excessive current flows due to a ground, shortage, etc. within an electric flow path and preventing a re-formation of an electric flow path after the electric flow path is blocked.

2. Description of the Conventional Art

Generally, a circuit breaker is used for blocking current flow when an excessive current is formed due to a ground, shortage, etc. within an electric line or indoor electric circuit.

Such conventional circuit breakers include a movable contact point formed on an upper end portion of the movable contact member which selectively contacts with one end portion of a fixed contact member.

The construction of the conventional circuit breaker will now be explained in more detail.

As shown in FIGS. 1 through 4, a movable contact guide member 14 is elastically supported by the upper portion of a contact spring 8 which is upwardly and elastically disposed below a holder 15.

An elongated guide hole 16 having a variation point 17 for stably maintaining a closed state of an electric circuit even when a vibration occurs is formed in a portion of the movable contact guide member 14. A guide pin 5 engaged to the movable contact member 1 is movably inserted into the elongated guide hole 16.

One end portion of a support member 18 is engaged to a portion of the holder 15 by a fixing pin 18*a*, and the other end portion of the same is engaged with a center portion of the movable contact member 1 by a support shaft 18*b*.

In addition, a movable contact point 12 is formed in an end portion of the movable contact member 1 which is movably connected to the movable contact guide member 14, and a fixed contact member 10 having a fixed contact point 11 which selectively contacts with the movable contact point 12 is formed below the movable contact point 12.

In the drawings, reference numeral 21 denotes a lead line.

The operation of the conventional circuit breaker will now be explained with reference to the accompanying drawings.

When the guide pin 5 is positioned at a right hand portion of the variation point 17 of the elongated guide hole 16 as shown in FIG. 3, since an elastic recovering force of the contact spring 8 which force is generated to rotate the movable contact member 1 in the counterclockwise direction, the fixed contact point 11 of the fixed contact member 10 and the movable contact point 12 of the movable contact member 1 contact with each other for thus closing the electric flow path.

In a state that the electric flow path is closed, when an excessive current flows within an electric flow path due to a ground, shortage, etc., since the current flowing directions of the fixed contact member 10 and the movable contact member 1 are opposite, a predetermined repulsion force is generated between the fixed contact member 10 and the movable contact member 1 by an electromagnetic repulsion force therebetween, so that the movable contact member 1 is rotated in the clockwise direction as shown in FIG. 2, and the movable contact member 1 is separated from the fixed contact member 10 for thus opening the electric flow path.

However, when the movable contact member 1 is rotated in the clockwise direction by the electro-magnetic repulsion force generated between the fixed contact member 10 and the movable contact member 1 of the circuit breaker, the compressing force of the contact spring 8 is increased when the guide pin 5 passing through the elongated guide hole 16 of the movable contact guide 14 is made closer from the right hand portion of the variation point 17. Therefore, a force which is applied to push the movable contact member 1 in the counterclockwise direction is increased.

In more detail, since the horizontal distance LZ between the support shaft 18*b* and the guide pin 5 which is positioned at an upper end portion of the elongated guide hole 16 is shortened when the guide pin 5 is moved closer from the right hand portion of the variation portion 17 to the variation point 17, the operational force of the contact spring 8 disposed in the elongated guide hole 16 is increased.

Therefore, when the electro-magnetic repulsion force generated between the movable contact member 1 and the fixed contact member 10 is greater than the contact force of the contact spring 8, the force which is applied to push the movable contact member 1 in the clockwise direction can overcome the pressure of the contact spring 8, so that the guide pin 5 inserted into the elongated guide hole 16 is moved toward the left hand portion of the variation point 17.

The operational force of the contact spring 8 which is applied to the guide pin 5 is changed to a force which is applied to rotate the support shaft 18 in the clockwise direction after the guide pin 5 is moved to the left hand portion of the variation point 17, and the thusly changed force is combined with the electro magnetic repulsion force, so that the circuit breaker is quickly opened.

The above-described current limiting apparatus for the conventional circuit breaker is disclosed in Korean Utility Model No. 8200, 1994.

However, in the conventional circuit breaker, when the electro magnetic repulsion force generated between the fixed contact member and the movable contact member due to an excessive current is decreased below a predetermined level, the electro magnetic repulsion force does not overcome the elastic force of the contact spring which, in turn, means the electric flow path is continuously maintained during excessive current.

In addition, since the rapid increase of the electro-magnetic repulsion force is needed until the position of the guide pin passes through the critical angle which is transferred from the right hand portion of the variation point to the left hand portion of the variation point, the amount of current which causes a current limiting operation is greatly increased, so that it is impossible to fabricate a compact sized circuit breaker is having a desired current limiting characteristic.

SUMMARY OF THE INVENTION

Accordingly, it is an object of the present invention to provide a current limiting apparatus for a circuit breaker which overcomes the aforementioned problem encountered in the conventional art.

It is another object of the present invention to provide an improved current limiting apparatus for a circuit breaker which makes it possible to effectively protect an electric load element by quickly blocking an electric flow path when an excessive current flows due to a ground, shortage, etc. within an electric flow path and preventing a re-formation of an electric flow path after the electric flow path is blocked.

To achieve the above objects, there is provided a current limiting apparatus for a circuit breaker which includes a fixed contact member having a U-shaped curved portion and a contact point formed at an end portion of the curved portion; a movable contact member having a contact point formed at an end portion of the same; a first pin hole formed in the center portion of the same, and a second pin hole oppositely spaced-apart from the contact point from the first pin hole, whereby the movable contact member is rotatable with respect to the first pin hole thereby selectively contacting the contact point with the contact point of the fixed contact member and separating the same; a movable contact rotation center pin movably inserted into the first pin hole and operated as a rotation center shaft of the movable contact member; a guide pin passing through the second pin hole and being extended from both side surfaces of the movable contact member; a holder, a portion of which supports both ends of the movable contact member rotation center pin; for rotatably supporting the movable contact member, a current limiting latch having a semicircular guide surface formed on one outer circumferential surface of the same on which the guide pin slidably moves, a support groove formed on another outer circumferential surface of the same; and a pin hole for supporting the holder, whereby the current limiting latch is rotatable with respect to the center of the pin hole; a rotation center pin inserted into the pin hole of the current limiting latch, both ends of said rotation center pin are inserted into portions of the holder; and a contact spring, both ends of which are supported by the support groove of the current limiting latch and the support surface of the holder for generating a force which prevents the movable contact member from being rotated in the counterclockwise direction.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
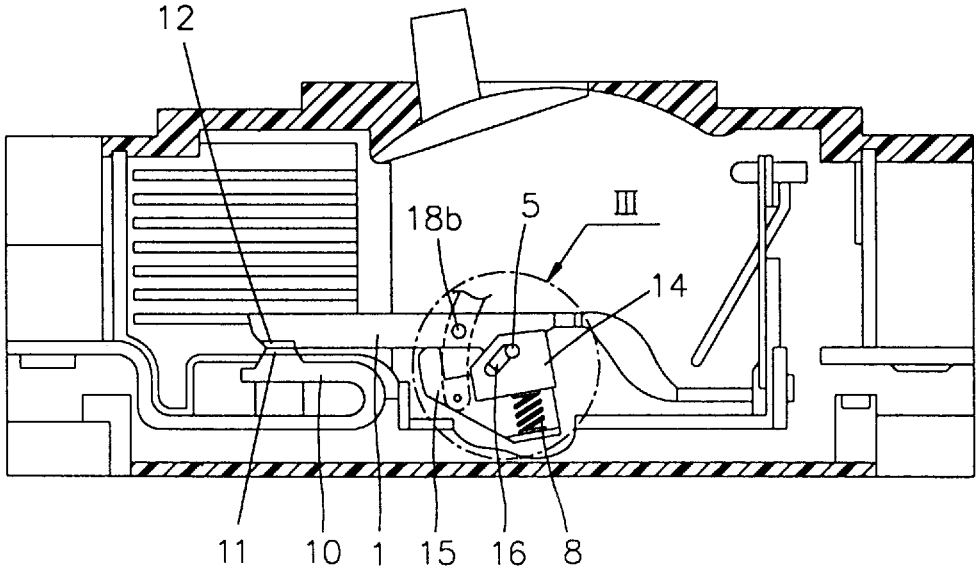
FIG. 1 CONVENTIONAL ART
FIG. 1 is vertical cross-sectional view illustrating a conventional circuit breaker.
Figure 2:
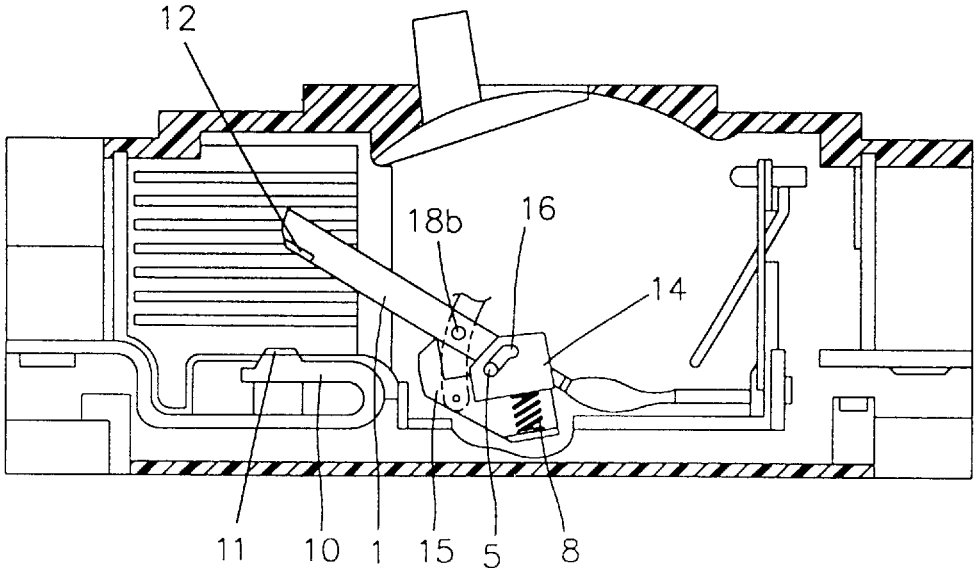
FIG. 2 CONVENTIONAL ART
FIG. 2 is a vertical cross-sectional view illustrating a state when circuit breaker is open.
Figure 3:
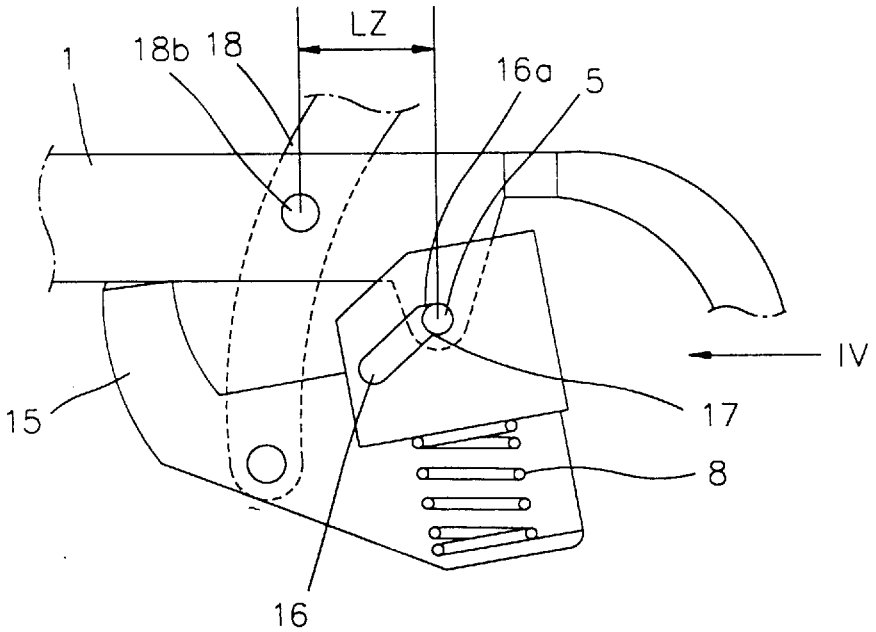
FIG. 3 CONVENTIONAL ART
FIG. 3 enlarged view of a portion lIl of FIG. 1.
Figure 4:
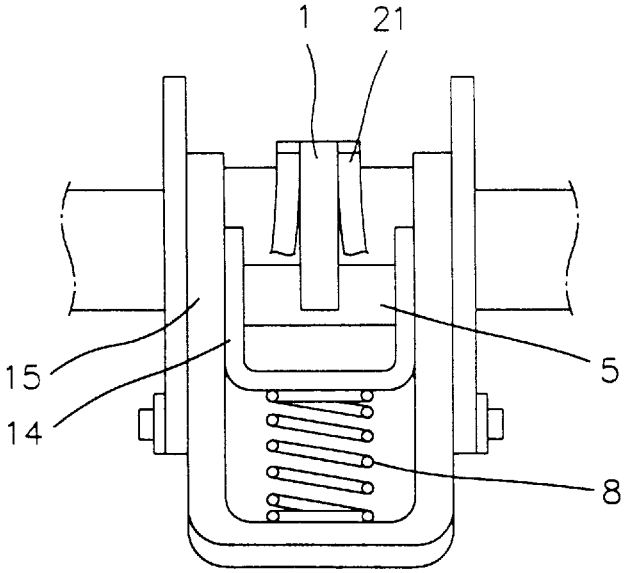
FIG. 4 CONVENTIONAL ART
FIG. 4 is a view taken by viewing the conventional circuit breaker in the direction IV of Fig. 3.
Figure 5:
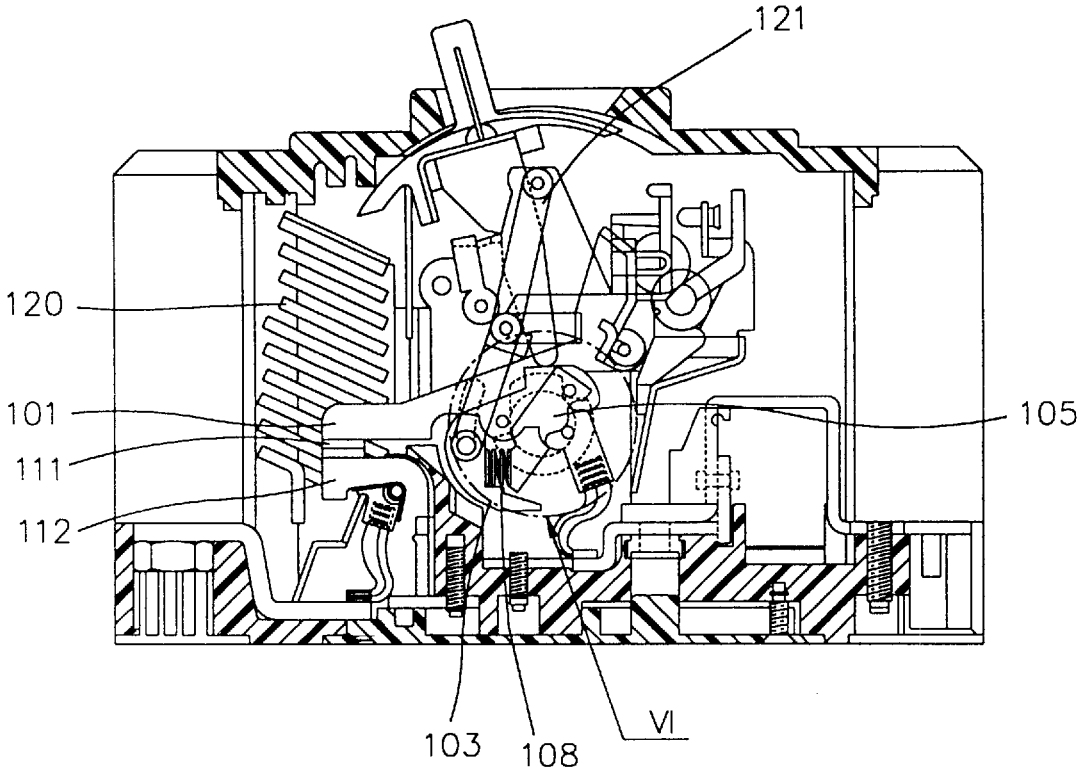
FIG. 5 is a vertical cross-sectional view illustrating a circuit breaker according to present invention.
Figure 6:
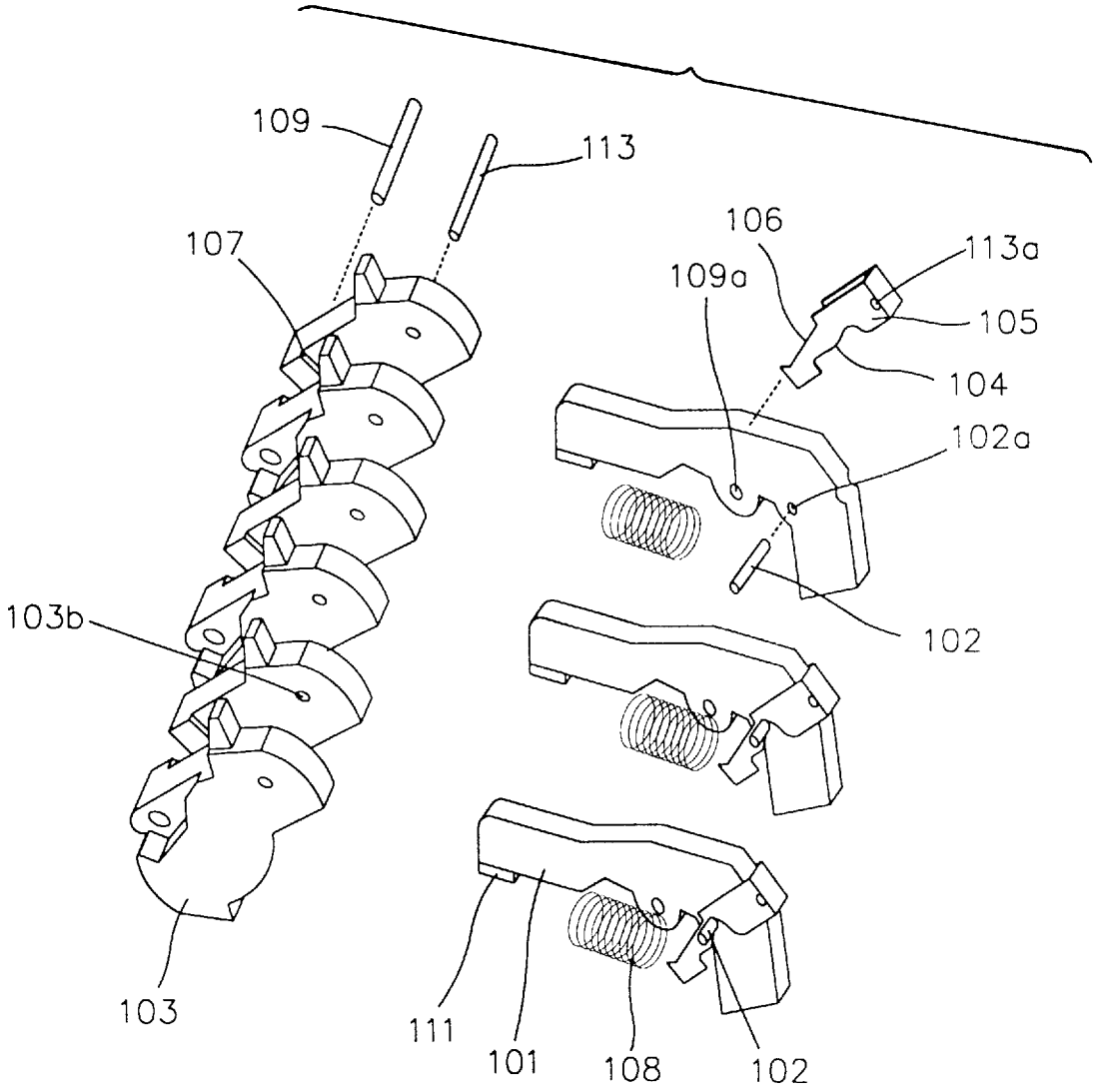
FIG. 6 an exploded perspective view illustrating the portion VI of FIG. 5 according to the present invention.

FIG. 5 illustrates a circuit breaker according to the present invention, and FIG. 6 illustrates the portion VI of FIG. 5 according to the present invention.

As shown therein, each of three movable contact members 101 of a current limiting apparatus for a circuit breaker according to the present invention includes a movable contact point 111 formed on the lower portion of each of the three movable contact members 101. A first pin hole 109*a* passing through the center portion of each of the three movable contact members 101. A second pin hole 102*a* is formed at a portion oppositely spaced-apart from the movable contact point 111 from the first pin hole 109*a*, and a guide pin 102 is inserted into the second pin hole 102*a* and is extended from one side surface of the movable contact member 101.

A movable contact rotation center pin 109 is rotatably inserted into the first pin hole 109*a* of each of the movable contact members 101 as shown in FIG. 7, and both end portions of the movable contact rotation center pin 109 are inserted into pin support holes (not shown) formed in a pair of inner wall surfaces of the holders 103.

Therefore, the movable contact member 101 is rotated with respect to the first pin hole 109*a* and contacts with or is separated from a fixed contact point 112 of a fixed contact member 110.

In addition, a current limiting latch 105 is rotatably engaged to a right hand surface of the movable contact member 101 which is rotatably engaged to the holder 103.

The rotatable engagement between the current limiting latch 105 and the holder 103 is obtained in such a manner that the current limiting rotation center pin 113 is rotatably inserted into the pin hole 113*a* formed in the upper portion of the current limiting latch 105, and both ends of the current limiting latch rotation center pin 113 is rotatably engaged to a pair of the pin support holes 103*b* of the holder 103.

A guide surface 104 on which the guide pin 102 is slidable is formed on an outer circumferential surface of the current limiting latch 105.

In addition, a support groove 106 is formed on another outer circumferential surface of the current limiting latch 105, and a support surface 107 is formed in an inner surface of the holder 103, so that a contact spring 108 is not escaped from the support groove 106 and the support surface 107.

The guide surface 104 of the current limiting latch 105 includes concave portions formed at both ends of the same and is shaped as a curve. Therefore, the operational force of the contact spring 108 which is applied to the guide pin 102 in the direction of preventing the rotation of the movable contact member 101 when the movable contact member 101 is rotated in the clockwise direction by the electro-magnetic repulsion force generated between the fixed contact member 110 and the movable contact member 101 when an over current occurs is slightly increased and then is decreased as the guide pin 102 is slidably moved.

In this embodiment of the present invention, there are provided three movable contact members 101 because three phases and three cables are used therefor. In the drawings, reference numeral 120 denotes an arc blocking grid, and 121 denotes an opening/closing link which is a part of an additional opening/closing apparatus for a circuit breaker.

The operation and effects of a current limiting apparatus for a circuit breaker according to the present invention will now be explained with reference to the accompanying drawings.

Figure 7A:
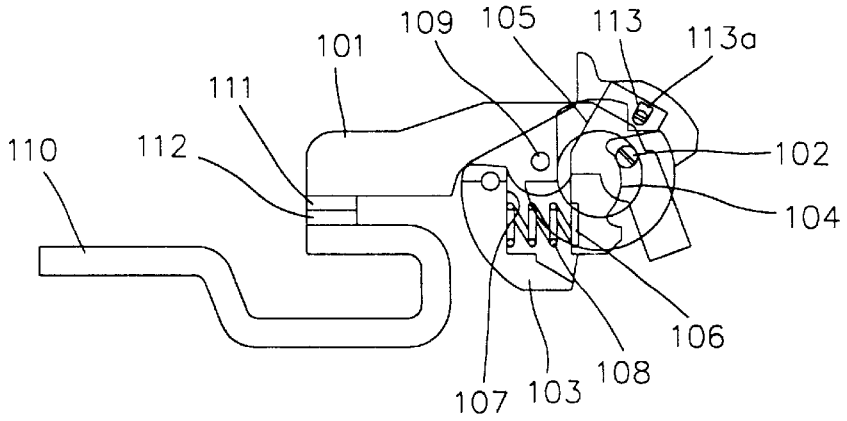
FIG. 7A is a vertical cross-sectional view illustrating a state where parts shown in FIG. 6 are assembled; and when a circuit breaker according to the present invention is closed.

First, as shown in FIG. 7A, in a state that the circuit breaker is closed, since the elastic recovering force of the contact spring 108 disposed between the support surface 107 of the holder 103 and the support groove 106 formed in an outer surface of the current limiting latch 105 is applied to rotate the movable contact member 101 in the counterclockwise direction with respect to the movable contact member rotation center pin 109, the fixed contact point 112 of the fixed contact member 110 and the movable contact point 111 of the movable contact member 101 contact with each other.

In the above-described state, when an excessive current flows due to a ground, shortage, etc. on a current flowing path, the fixed contact point 112 and movable contact point 111 are separated from each other by the electro magnetic repulsion force generated between the fixed contact member 110 and the movable contact member 101.

Figure 7B:
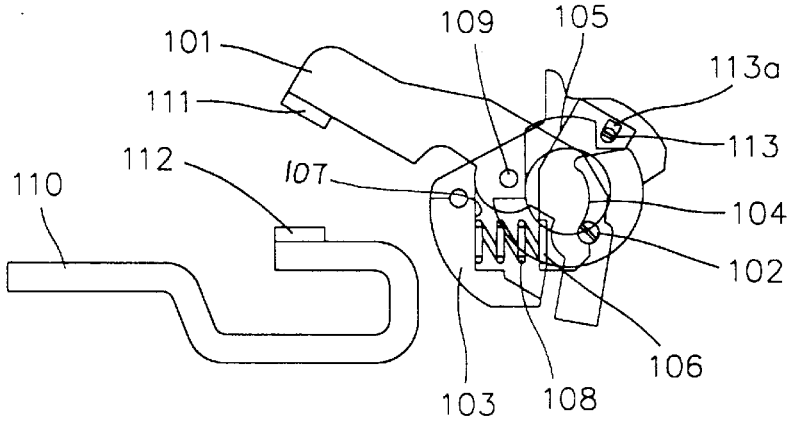
FIG. 7B is a vertical cross-sectional view illustrating a state that parts shown in FIG. 6 are assembled and when a circuit breaker according to the present invention is open.

Therefore, the movable contact member 101, as shown in FIG. 7B, is rotated in the clockwise direction and then is separated from the fixed contact member 110 for thus opening the current flowing path.

The above-described operation will now be explained in more detail.

First, as the movable contact member 101 is rotated in the clockwise direction by the electro-magnetic repulsion force, the guide pin 102 rotatably engaged to the movable contact member 101, as shown in FIG. 7B, is downwardly moved from the upper portion of the guide surface 104 formed in one outer circumferential surface of the current limiting latch 105.

When the current limiting latch 105 contacting with the guide pin 102 by the movement of the guide pin 102 is rotated in the clockwise direction with respect to the current limiting latch rotation center pin 113, the contact spring 108 disposed between the support groove 106 of the current limiting latch 105 and the support surface 107 of the holder 103 is compressed.

At this time, since the horizontal distance between the center of the movable contact member rotation center pin 109 and the center of the guide pin 102 is shortened more and more, the contact spring 108 is compressed, so that the elastic force of the contact spring 108 is increased.

However, during the operation when the guide pin 102 is moved from the upper portion to the lower portion along the guide surface 104 of the current limiting latch 105, since the guide surface 104 of the current limiting latch 105 includes a curved portion which does not have a variation point, compared to the conventional circuit breaker, the operational force of the contact spring 108 which is applied to the guide pin 102 in the direction that prevents the rotation of the movable contact member 101 (from the contact position where contact points 111 and 111 engage) is slightly increased at a predetermined rotational angle of the movable contact member 101 or up to a portion of the guide surface 104 and then is decreased at a perdetermined rotational angle.

Figure 8:
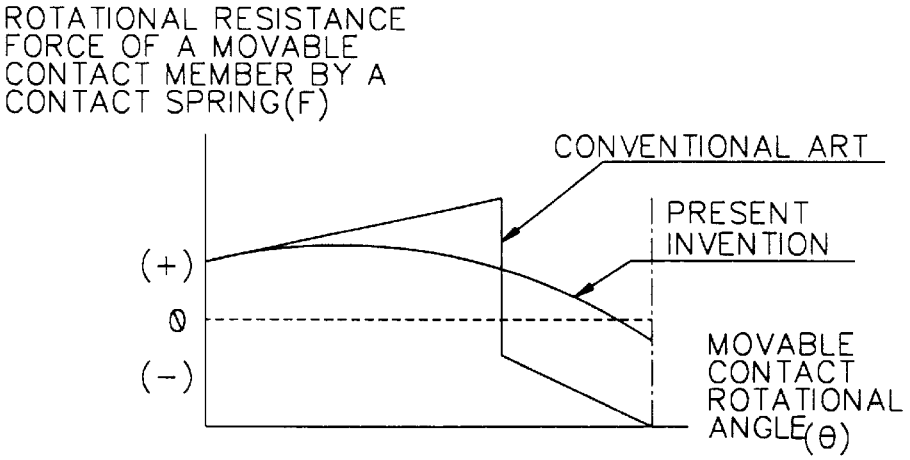
FIG. 8 is a graph illustrating a current limit characteristic in comparison with a force increase ratio, which is used for preventing the rotation of a movable contact member based on a rotational angle of the movable contact member; the graph also shows a comparison between the current limiting apparatus according to the present invention and a conventional current limiting apparatus.

Namely, the current limiting apparatus for a circuit breaker according to the present invention, as shown in FIG. 8, has a current limiting characteristic that the force of the contact spring 108 which prevents the rotation of the movable contact member 101 when the guide pin 102 is moved along the guide surface 104 is slightly increased and then decreased unlike the conventional current limiting characteristic where the force of the contact spring which prevents the rotation of the movable contact member 101 is sharply increased up to the critical angle and then is sharply decreased after the critical angle.

Therefore, even though the electro-magnetic repulsion force is small, the guide pin 102 is smoothly moved along the guide surface 104. In addition, as shown in FIG. 7B, the contact pressure of the contact spring 108 is converted into the clockwise moment of rotational force which enables the rotation of the movable contact member 101 at the time when the guide pin 102 passes through a lower portion, whereby the rotational moment of rotational force is combined with the electro-magnetic repulsion force, thereby rapidly opening the circuit breaker.

In addition, in the circuit breaker according to the present invention, since there are formed concave portions at both ends of the guide surface of the current limiting latch 105, at the time when the current limiting operation is finished, the guide pin 102 is inserted into the concave portion, whereby it is possible to maintain an opened state of the circuit breaker as shown in FIG. 7B without reforming the current flow.

Therefore, it is possible to prevent a reformation of current flowing because less electro-magnetic repulsion force is generated when an excessive current is generated.

As described above, the current limiting apparatus for a circuit breaker according to the present invention is capable of accurately and rapidly blocking current flow without increasing the current value at which the current limiting operation begins when an excessive current occurs within an electric line thereby effectively preventing a re-formation of a current flow and increasing a current limiting characteristic, whereby it is possible to enhance the reliability of the circuit breaker.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. A current limiting apparatus for a circuit breaker, comprising:

a fixed contact member having a U-shaped curved portion formed by two legs and a contact point formed at an end portion of a leg of said U-shaped curved portion;

a movable contact member with side surfaces having a contact point formed at an end portion thereof, a first pin hole formed in a center portion of said movable contact member, and a second pin hole oppositely spaced-apart from the first pin hole, whereby the movable contact member is rotatable with respect to the first pin hole thereby selectively contacting the contact point of said movable contact member with the contact point of the fixed contact member;

a first rotation center pin movably inserted into the first pin hole and operated as a rotation center shaft of the movable contact member, said first rotation center pin has two ends;

a guide pin passing through the second pin hole and being extended from said side surfaces of the movable contact member;

a holder, a portion of said holder supports said ends of the first rotation center pin, for rotatably supporting the movable contact member;

a current limiting latch having a curved guide surface formed on one outer circumferential surface of said latch on which the guide pin slidably moves, a support groove formed on another outer circumferential surface of said current limiting latch, and a third pin hole for supporting the holder, whereby the current limiting latch is rotatable with respect to the center of the third pin hole;

a second rotation center pin inserted into the third pin hole of the current limiting latch, both ends of said second rotation center pin are inserted into portions of the holder; and a contact spring, having two ends, one end of said contact spring is supported by the support groove of the current limiting latch and another end of said spring is supported by the support surface of the holder, said latch and said spring generating a variable force which prevents the movable contact member from being rotated, said force varying according to respective positions of said guide pin along said curved guide surface of said latch, whereby current flow is rapidly blocked without increasing current value at which a current limiting operation of said apparatus begins.

2. The apparatus of claim 1, wherein pin support holes are formed in inner wall surfaces of the holder.

3. The apparatus of claim 1, wherein the length of the guide pin is shorter than the distance between the neighboring holders.

4. The apparatus of claim 1, wherein said current limiting latch includes a U-shaped cross section and is disposed in such a manner that the movable contact member is covered from the upper portion of the same through the opened portion of the U-shape.

5. The apparatus of claim 1, wherein said guide surface of the current limiting latch is arc-shaped.

6. The apparatus of claim 1, wherein said guide surface of the current limiting latch includes concave portions formed at both ends of the same.

7. The apparatus of claim 1, further comprising three movable contact members, three fixed contact members, three current limiting latches, and three contact springs.

* * * * *